US006658796B1

(12) United States Patent
Higgins

(10) Patent No.: US 6,658,796 B1
(45) Date of Patent: Dec. 9, 2003

(54) GUTTER HOOD SUPPORT BRACKET

(76) Inventor: Callaway Bode Higgins, 156 Divinity St., Bristol, CT (US) 06010

( * ) Notice: Subject to any disclaimer, the term of this patent is extended or adjusted under 35 U.S.C. 154(b) by 0 days.

(21) Appl. No.: 10/120,990

(22) Filed: Apr. 11, 2002

Related U.S. Application Data

(60) Provisional application No. 60/283,129, filed on Apr. 12, 2001.

(51) Int. Cl.[7] ..... E04D 13/08

(52) U.S. Cl. ..... 52/11; 52/713; 248/48.2

(58) Field of Search ..... 52/11, 12, 712, 52/713; 248/48.1, 48.2, 245.11, 296.1, 297.21, 297.31, 292.12

(56) References Cited

U.S. PATENT DOCUMENTS

| | | | | | |
|---|---|---|---|---|---|
| 2,672,832 | A | | 3/1954 | Goetz | |
| 3,296,749 | A | * | 1/1967 | Cotter | |
| 3,333,803 | A | * | 8/1967 | Landis | |
| 3,737,127 | A | * | 6/1973 | Maloney, Jr. et al. | 248/48.2 |
| 3,752,428 | A | * | 8/1973 | Trostle et al. | 248/48.1 |
| 4,241,548 | A | | 12/1980 | Rowe | |
| 4,757,649 | A | | 7/1988 | Vahldieck | |
| 4,876,827 | A | | 10/1989 | Williams | |
| 5,271,192 | A | | 12/1993 | Nothum, Sr. et al. | |
| 5,388,377 | A | * | 2/1995 | Faulkner | 52/11 |
| 5,575,118 | A | * | 11/1996 | Vahdieck | 52/11 |
| 5,617,678 | A | * | 4/1997 | Morandin et al. | 52/11 |
| 5,737,879 | A | * | 4/1998 | Sweet | 52/12 |
| 5,845,435 | A | | 12/1998 | Knudson | |
| 5,884,876 | A | * | 3/1999 | Axford | 248/48.2 |

* cited by examiner

*Primary Examiner*—Carl D. Friedman
*Assistant Examiner*—Yvonne M. Horton
(74) *Attorney, Agent, or Firm*—Alix, Yale & Ristas, LLP

(57) ABSTRACT

A bracket assembly for supporting a gutter and hood includes a gutter support bracket and a mating hood support bracket. The gutter support bracket provides a cantilever support for a K-type gutter by connecting the front and rear lips of the gutter. The hood support bracket fastens to the gutter support bracket such that fastener-receiving apertures defined in both brackets align. The hood is supported by an upper arm of the hood support bracket in a position to define a longitudinal gap between the hood forward lip and the gutter front lip. A fastening tool and fastener are inserted through the gap to secure the hooded gutter assembly to a structure.

10 Claims, 6 Drawing Sheets

GUTTER HOOD SUPPORT BRACKET

CROSS REFERENCE TO RELATED APPLICATIONS

This application claims the benefit of U.S. Provisional Application No. 60/283,129, filed Apr. 12, 2001.

BACKGROUND OF THE INVENTION

1. Field of the Invention

This invention generally relates to the support of gutters that collect runoff from the roof of a structure and more particularly to a bracket for supporting a protective hood over a gutter.

2. Description of the Related Art

Gutters are essentially an elongated open trough attached at the edge of a roof to collect and divert runoff from the roof. A problem with open gutters is that they tend to collect leaves and other debris that blocks the flow of runoff and may lead to water damage to the structure. Frequent cleaning of the gutter to remove debris is required unless the gutter is covered to prevent such debris accumulation. It is known in the art to apply a hood or shield over the gutter to prevent debris accumulation. Some hoods are in the form of a screen or grate that allows water to pass through while preventing debris from entering the gutter trough.

A preferred alternative gutter hood comprises a curved sheet of metal or plastic arranged over the gutter trough. Water follows the curvature of the hood into the trough while leaves and debris cannot. Many alternative configurations for such a hooded gutter have been proposed. Some hooded gutters, such as those disclosed in U.S. Pat. Nos. 4,757,649 and 5,845,435 (hereinafter the '649 and '435 patents, respectively), utilize a one-piece longitudinal extrusion that forms both the hood and trough portions of the gutter. The '435 patent further discloses support brackets with an outer end configured to engage both the trough and the outward projecting portion of the hood. A major drawback to the approach proposed in the '435 and '649 patents is that they are not compatible with most existing extruded gutters. These systems require the replacement of all existing gutters with their alternative proprietary gutter format, which may or may not be compatible with the existing fascia and/or drip edge configuration of the structure.

In a structure where the roof, fascia and existing gutters are in good repair, the homeowner may wish to install a gutter hood. Preferably the hood can be installed without disturbing the integrity of the roof, replacing the gutter or reconfiguring the fascia. Many of the prior art hooded gutter systems cannot be used for such an application. For example, U.S. Pat. No. 5,388,377 illustrates a gutter hood compatible with a conventional gutter but requiring that a leaf screen be inserted beneath the shingles, thus disturbing the integrity of an installed roof and providing a path for ice and/or moisture to accumulate under the shingles.

The extruded "K-ty pe" gutter is the industry standard and are installed on the vast majority of structures, particularly residential structures. Most prior art hooded gutter systems are incompatible with standard K-type extruded gutters, cannot be retrofitted to existing K-type extruded gutters and may require the purchase of expensive proprietary equipment and mounting hardware. Further, the form and configuration of the gutter hood is frequently dictated by the configuration of the proprietary hardware, necessitating the purchase not only of the hardware but also of equipment to manufacture a hood in a compatible configuration.

There is a need in the art for a hooded gutter system compatible with existing conventional K-type gutters. There is also a need in the art for a hooded gutter system that does not require the purchase of proprietary gutter and/or hood fabricating equipment. There is a further need for a bracket, K-type gutter and hood assembly that may be installed without disturbing the integrity of and existing roof system.

SUMMARY OF THE INVENTION

Briefly stated, the invention comprises a hood support bracket configured to mate with a gutter support bracket to provide a mounting location for a hood above a conventional K-type gutter. The bracket is configured such that the hood may be inexpensively manufactured in a variety of formats using readily available materials and standard non-proprietary tools. The hood support bracket and gutter support bracket can be used to retrofit a hood to existing K-type gutters. Further, the hood support bracket and its mating gutter support bracket permit fabrication of a hooded gutter assembly on the ground. Once assembled, the hooded gutter assembly requires only a single trip to the roofline for installation.

An object of the present invention is to provide a new and improved gutter hood support bracket and mating gutter support bracket that are compatible with conventional K-type gutters.

Another object of the present invention is to provide a hooded gutter system that can be assembled on the ground and installed to a building in a single step.

A further object of the present invention is to provide a new and improved hooded gutter system that does not require reconfiguring the fascia or disturbing the integrity of an existing roof.

A yet further object of the present invention is to provide a new and improved gutter hood support bracket that permits the hood to be inexpensively manufactured in a variety of formats using readily available materials and standard non-proprietary tools.

DETAILED DESCRIPTION OF THE PREFERRED EMBODIMENT

Figure 1:
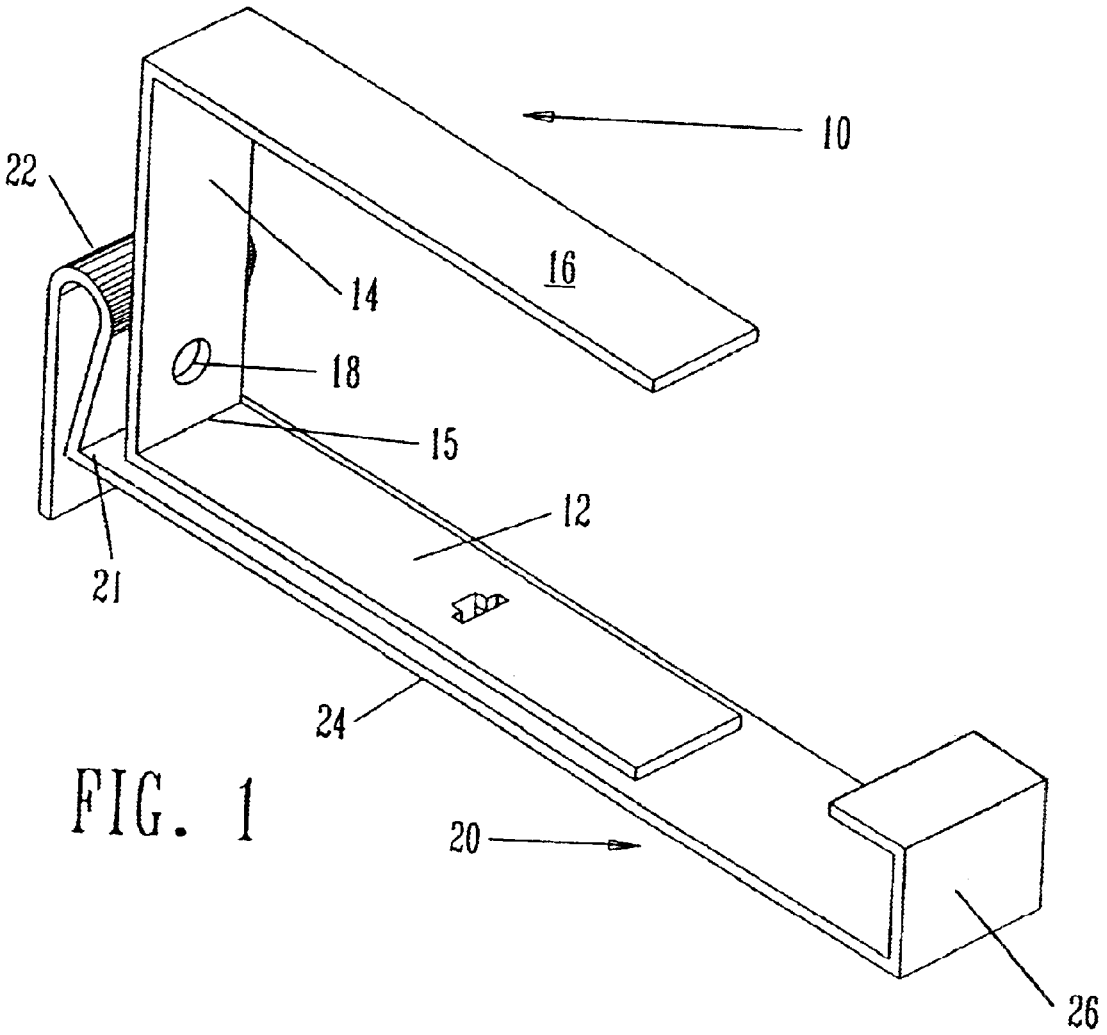
FIG. 1 is a oblique perspective view of a hood support bracket mated to a gutter support bracket in accordance with the present invention.
Figure 1A:
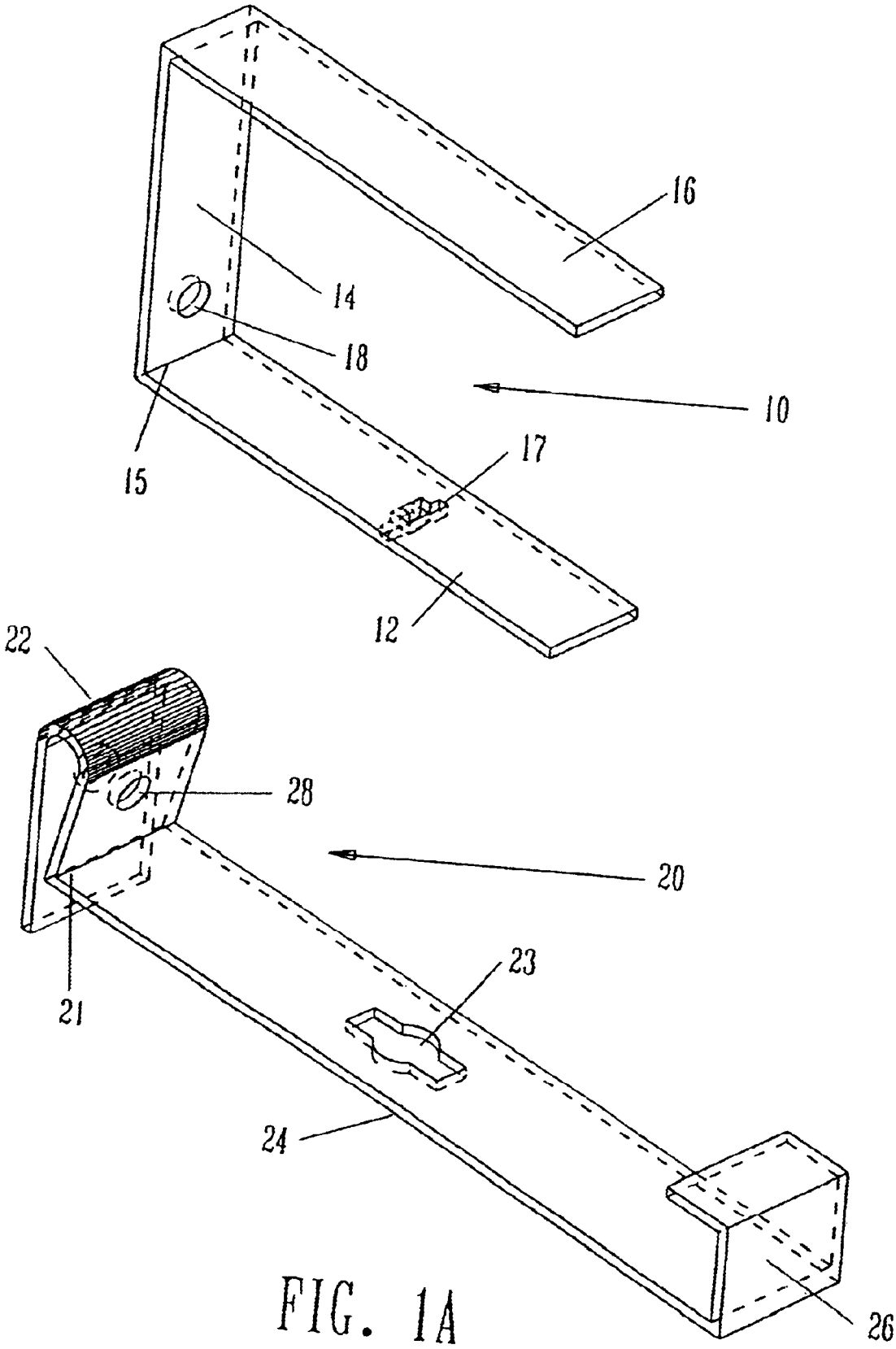
FIG. 1A is an exploded perspective view of the hood support bracket and gutter support bracket of FIG. 1.

FIGS. 1–7C illustrate a hooded gutter system 60 incorporating a hood support bracket 10 in accordance with the present invention. FIGS. 1 and 1A illustrate one preferred embodiment of the primary bracket components of the hooded gutter system 60. A gutter support bracket 20 is configured to be compatible with standard extruded K-type gutters. A rear clip 22 is configured to engage over the rear lip of the K-type gutter. A front coupler 26 of the gutter support bracket 20 is configured to engage and support the front lip of a standard K-type extruded gutter. The rear clip 22 and front coupler 26 are connected by a bar 24.

With reference to FIGS. 1, 1A and 7A–7C, the illustrated hood support bracket 10 is a generally C-shaped bent metal bracket comprising a top arm 16, a bottom arm 12 and a connector portion 14 integral to and extending between the top and bottom arms. The junction 15 of the connector portion 14 and bottom arm 12 is illustrated in the form of a right angle, although other configurations are possible. The connector portion 14 adjacent the bottom arm 12 defines a fastener-receiving aperture 18 best seen in FIGS. 1–3. The bottom arm 12 of the hood support bracket 10 comprises means, in the form of a clip 17, for fixing the bottom arm 12 to the bar 24 of the gutter support bracket 20. The hood support bracket clip 17 is configured to be received in a key slot 23 in the bar 24 of the gutter support bracket 20. When attached together as illustrated in FIG. 1, a pair of aligned fastener-receiving apertures 28 in the rear clip of the gutter support bracket align with the fastener-receiving aperture 18 defined by the hood support bracket 10 as best seen in FIG. 3.

Figure 2:
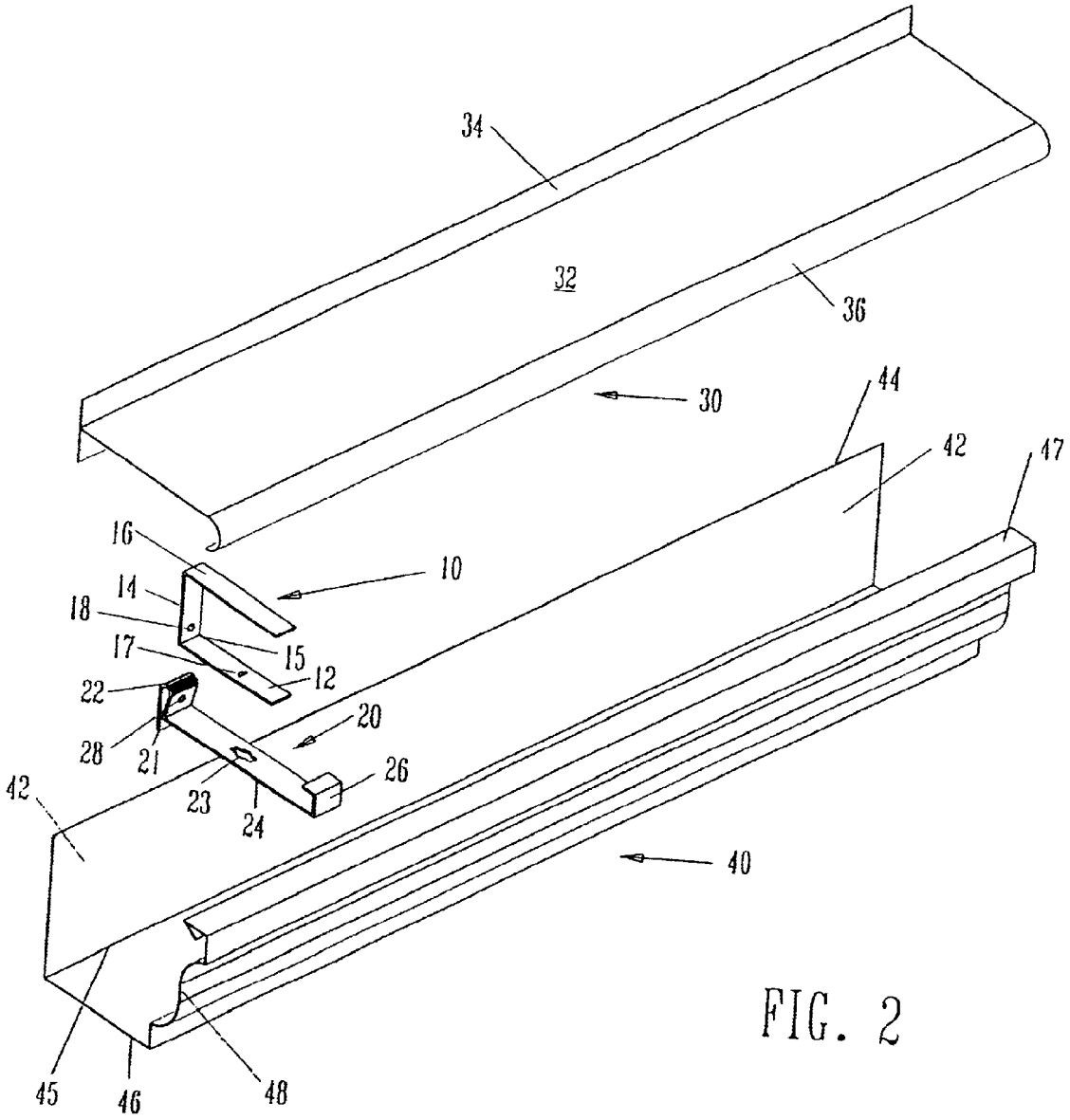
FIG. 2 is an exploded perspective diagram illustrating the components of a hooded gutter system in accordance with the present invention.

FIG. 2 is an exploded diagram illustrating the components of one preferred hooded gutter system in accordance with the present invention. An extruded K-type gutter 40 is shown at the bottom of the Figure. K-type gutters are presently installed on many homes and are the type produced by a substantial majority of gutter extruding equipment. A hooded gutter system incorporating the K-type gutter and a gutter support bracket compatible with the K-type gutter has the advantage of being compatible with most existing extruded gutters and gutter extruding equipment.

A gutter hood or shield 30 is illustrated at the top of FIG. 2. The hood 30 extends transversely to its length from a back splash 34 to a forward lip 36. The illustrated configuration is one example of a hood 30. It will be apparent to one of skill in the art that the configuration of the hood 30 is not dictated by the configuration of the hood support bracket 10. This leaves the installer free to fabricate a hood configuration that is compatible with the available materials and equipment. For example, the illustrated forward lip 36 is shown in the form of a curve. Fabrication of a curved forward lip may not be compatible with the installer's equipment. In such a case, the forward lip may be configured as a plurality of consecutive bends separated by straight portions to form a convex surface. The function of the forward lip is to guide runoff from the roof around its convex surface and into the gutter trough 45. The configuration must be one that allows the water to adhere and follow the surface due to surface tension.

Figure 3:
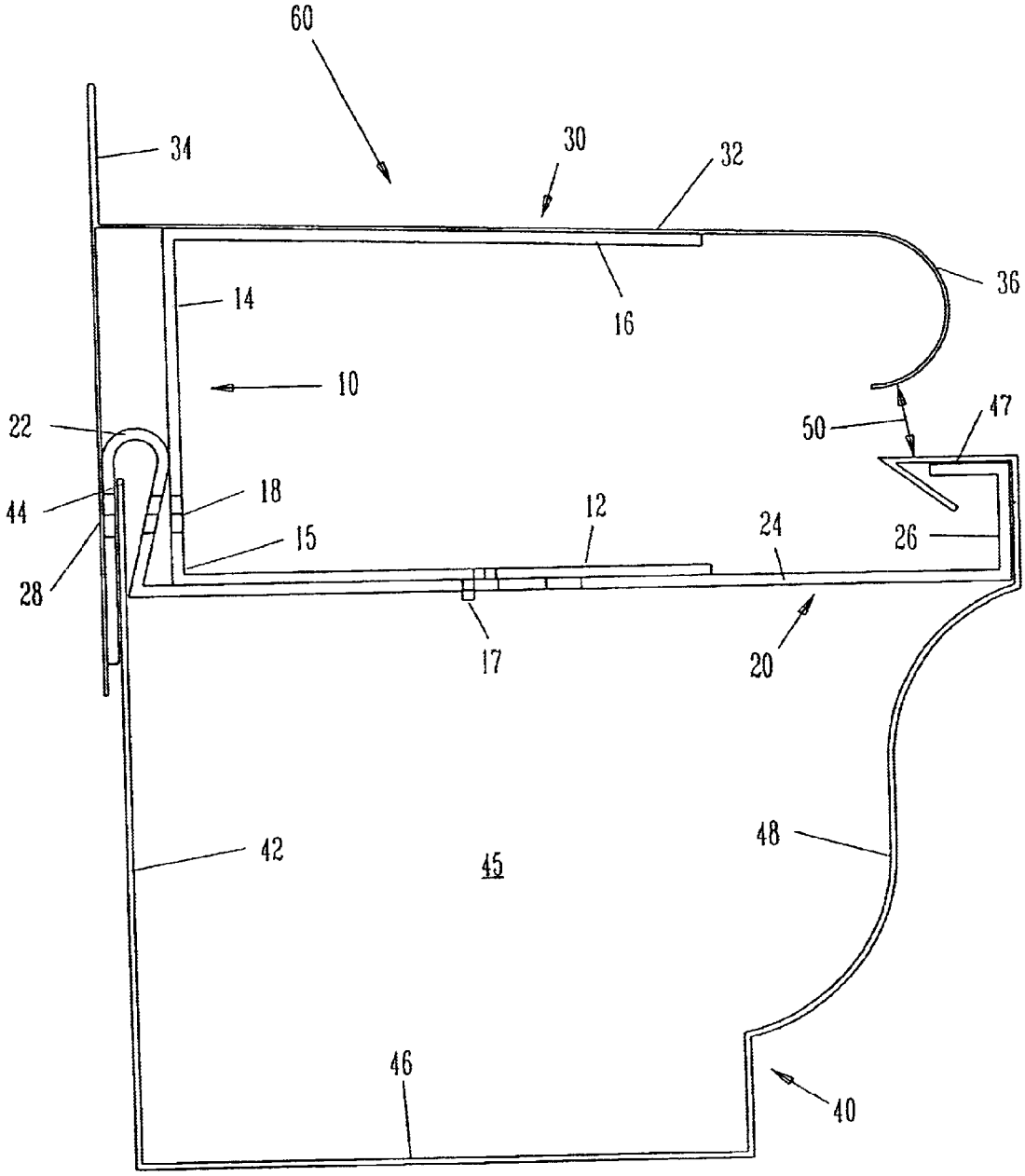
FIG. 3 is a side sectional view through a hooded gutter system in accordance with the present invention.

With reference to FIG. 3, it should be noted that the K-type gutter 40 has a substantially planar rear wall 42 extending from the rear lip 44 to the bottom surface 46 of the gutter. The bar 24 of the gutter support bracket 20 effectively connects the front lip 47 to the rear lip 44 of the gutter to form a cantilever support for the gutter. Downward force applied at the front lip 47 is transmitted to the structure to which the gutter is mounted through the planar back wall 42 because the distance between the front and rear lips is fixed by the gutter support bracket. FIG. 3 illustrates an embodiment of the hooded gutter assembly 60 where the back splash 34 of the hood 30 extends downwardly to overlap the rear lip 44 of the gutter.

The upper arm 16 of the hood support bracket 10 may be straight as shown or may have a convex curve or angled configuration. The back splash 34 extends both upwardly and downwardly from the cover portion 32 of the hood 30. The back splash 34 is configured to extend upwardly behind a drip edge (if present, not shown here) or to abut the underside of any overhanging roof material. The roof material is not disturbed and the upward extension of the back splash prevents runoff from passing behind the gutter. The downward projecting portion of the back splash 34 may be extended to overlap the rear lip 44 of the gutter 40 as illustrated in FIG. 3.

Figure 4:
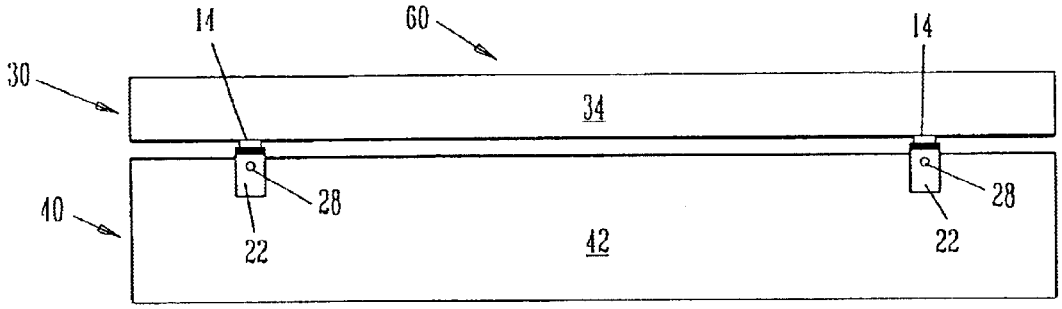
FIG. 4 is a rear plan view of an assembled hooded gutter system in accordance with the present invention.
Figure 5:
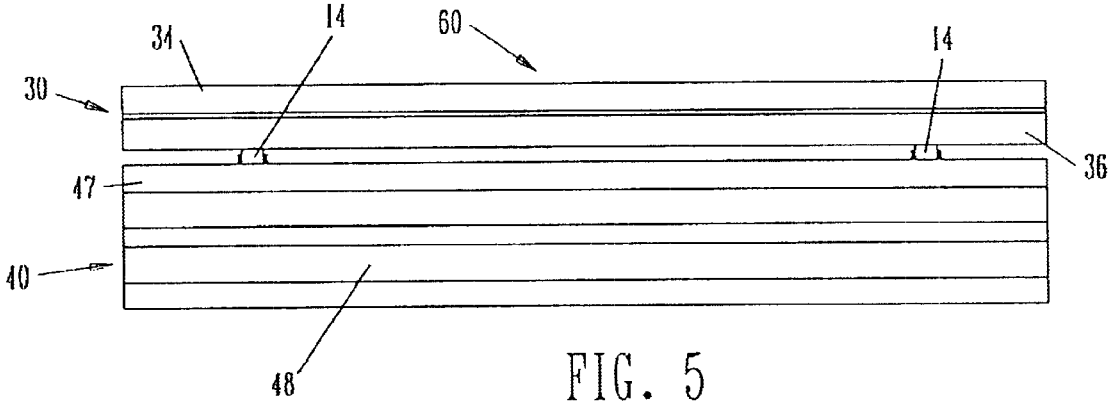
FIG. 5 is a front plan view of the hooded gutter system of FIG. 4.
Figure 6:
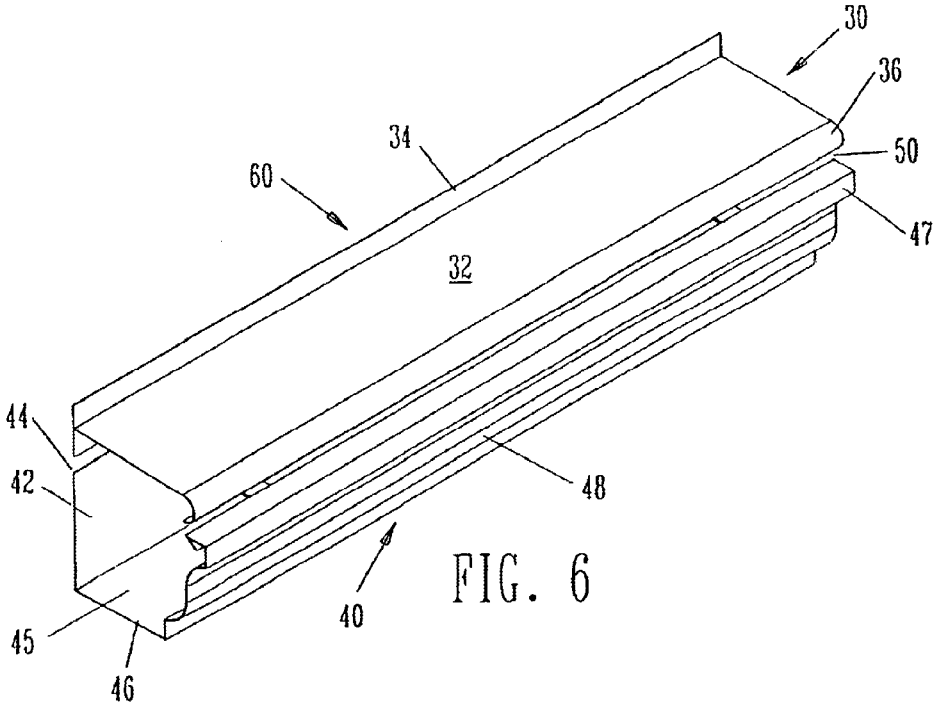
FIG. 6 is an overhead perspective view of the hooded gutter system of FIGS. 4 and 5.
Figure 7A:
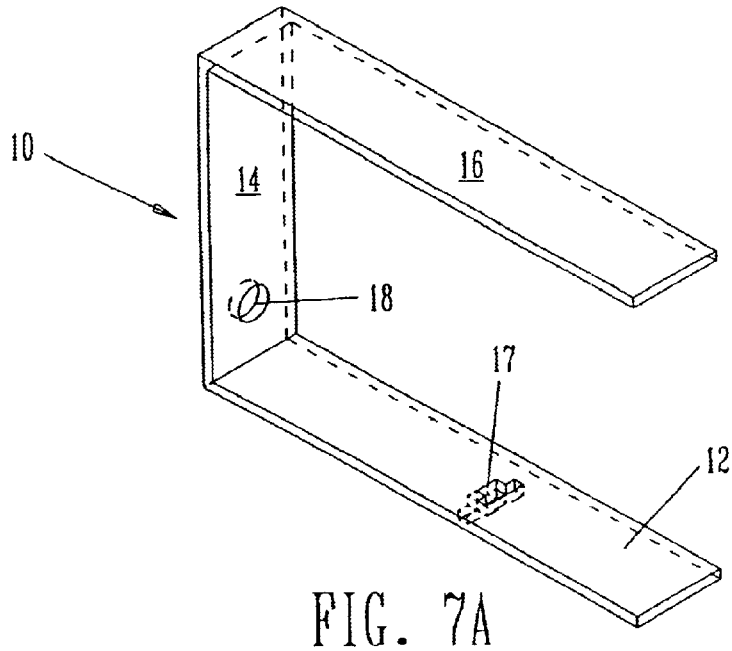
FIGS. 7A–7C are perspective, side and front views, respectively, of a hood support bracket in accordance with the present invention.
Figure 7B:
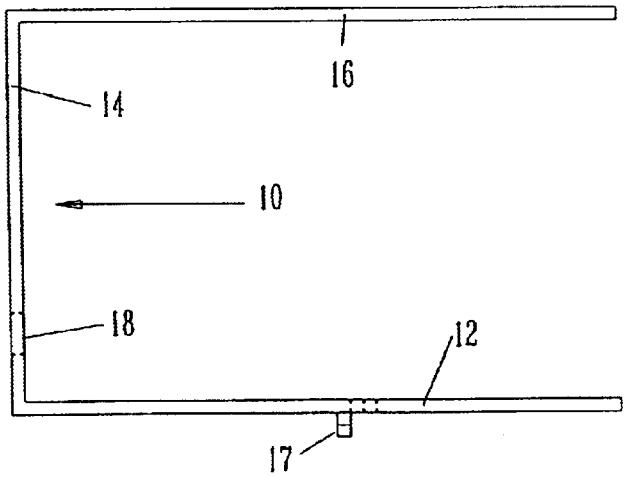
Figure 7C:
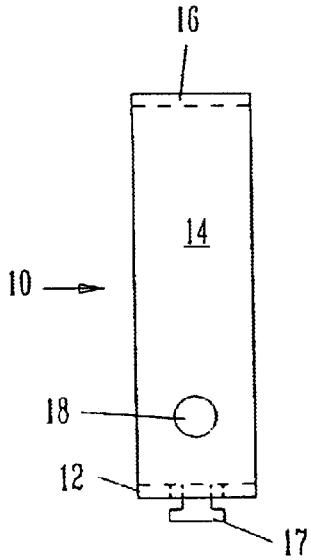

FIGS. 4, 5 and 6 are rear, front and perspective views, respectively, of the assembled hooded gutter system 60 illustrated in FIG. 3. With the hood support bracket 10 fixed relative to the gutter support bracket 20 and the fastener receptacles 18, 28 aligned, a single fastener (not shown) passing through the aligned fastener receptacles and rear wall of the gutter is all that is necessary to attach the hooded gutter system to a structure. When the downward projecting portion of the back splash 34 overlaps the rear lip 44 of the gutter, the fastener will also pass through the back splash 34, further improving the structural integrity of the assembly. A longitudinal gap 50 is defined between the forward lip 36 of the hood and the front lip 47 of the gutter 40 to permit insertion of a fastener-bearing driving tool (not illustrated) without disturbing the assembled hooded gutter 60.

Unlike many prior art systems, the illustrated hooded gutter system 60 may be fabricated and assembled at ground level, then raised and installed using a single row of fasteners in a single step. The inventive hooded gutter system thus increases efficiency and reduces worker exposure to the hazards of work at roof level on a ladder or scaffolding.

Many means for fixing the hood support bracket 10 to the gutter support bracket 20 will occur to those of skill in the art. In the illustrated preferred embodiment, the gutter support bracket 20 defines a longitudinally extending keyhole-shaped slot 23. The hood support bracket 10 is provided with a clip 17 punched out of the lower arm material. The clip 17 has laterally projecting tabs which are inserted through the gutter support bracket slot 23 with the hood support bracket 10 parallel to the bar 24 of the gutter support bracket 20. The hood support bracket 10 is then rearwardly engaged to bring the junction 15 of the connector 14 and lower arm 12 to bear against the rear clip 22 of the gutter support bracket 20. The hood support bracket 10 and gutter support bracket 20 may preferably be configured so that, when they are in the positions illustrated in FIG. 1, there is a press fit or some tension between the brackets. Such a press fit will help retain the brackets 10, 20 in position during assembly and installation of the hooded gutter system 60.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A bracket assembly for fitting inside and supporting both an elongated gutter having a front wall upwardly terminating in a front lip and a back wall upwardly terminating in a rear lip connected by a bottom wall to define a gutter channel with a top opening and a separately formed elongated hood having a top surface extending forwardly and downwardly from a back splash generally perpendicular to the top surface to a forward lip, said support bracket assembly comprising:

a gutter support bracket comprising:

a rear clip engageable over the rear lip of the gutter, said rear clip defining a first fastener receiving aperture;

a front coupler engageable inside the front lip of the gutter; and a bar integral to, and extending between the rear clip and the front coupler to define a first junction where the bar meets. the rear clip; and a hood support bracket comprising:

a bottom arm;

a top arm; and a connector portion integral to and extending between the bottom and top arms to define a second junction where the bottom arm meets the connector portion, said connector portion defining a second fastener receiving aperture; and a clip projecting from one of said bottom arm or said bar engageable with a complementary slot defined by the other of said bottom arm or said bar with the first and second junctions interfitting such that said first and second fastener receiving apertures are aligned.

2. The bracket assembly of claim 1, wherein the bottom arm, connector portion and top arm are substantially straight portions of a bent metal bracket.

3. A hooded gutter assembly comprising:

an elongated gutter having a front wall upwardly terminating in a longitudinally extending front lip and a substantially planar back wall upwardly terminating in a rear lip-connected by a bottom wall to define a gutter channel with a top opening;

an elongated hood having a cover portion extending from a back splash to a forward lip, said back splash extending both upwardly and downwardly from said cover and generally perpendicular thereto; and a gutter support bracket comprising:

a rear clip engageable over the, rear lip of the gutter, said rear clip defining a first fastener receiving aperture;

a front coupler engageable inside the front lip of the gutter; and a bar integral to and extending between the rear clip and the front coupler to define a rear junction where the bar meets the rear clip; and a hood support bracket comprising:

a bottom arm;

a top arm; and a connector portion integral to and extending between the bottom and top arms to define a bottom junction where the bottom arm meets the connector portion, said connector portion defining a second fastener receiving aperture;

wherein said gutter support bracket is installed in the gutter with the rear clip engaged over the rear lip and the front coupler engaged inside the front lip, the hood support bracket is fixed to the gutter support bracket with the bottom arm adjacent the bar and the rear and bottom junctions interfitting such that said first and second fastener receiving apertures are aligned and said hood is attached to the hood support bracket whereby a gap is defined between the forward lip and the front lip.

4. The hooded gutter assembly of claim 3, wherein said back splash extends downwardly from said cover portion to overlap the rear wall of said gutter.

5. The hooded gutter assembly of claim 3, wherein said assembly is secured to a structure by means of a fastener inserted through said first and second fastener receiving apertures and the rear wall of said gutter.

6. The hooded gutter assembly of claim 4, wherein said assembly is secured to a structure by means of a fastener inserted through said first and second fastener receiving apertures, said fastener also penetrating the rear wall of said gutter and the backsplash.

7. The hooded gutter system of claim 3, wherein the hood support bracket is fixed to the gutter support bracket by means of a clip projecting from one of the hood support bracket lower arm or the bar of the gutter support bracket engaged with a complementary slot defined in the other of said hood support bracket lower arm or said bar of the gutter support bracket.

8. A method for assembling a hooded gutter assembly comprising:

an elongated gutter having a front wall upwardly terminating in a longitudinally extending front lip and a substantially planar back wall upwardly terminating in a rear lip connected by a bottom wall to define a gutter channel with a top opening;

an elongated hood having a cover portion extending from a back splash to a forward lip, said back splash extending both upwardly and downwardly from said cover and generally perpendicular thereto; and a gutter support bracket comprising:

a rear clip engageable over the rear lip of the gutter, said rear clip defining a first fastener receiving aperture;

a front coupler engageable inside the front lip of the gutter; and a bar integral to and extending between the rear clip and the front coupler to define a rear junction where the bar meets the rear clip; and a hood support bracket comprising:

a bottom arm;

a top arm; and a connector portion integral to and extending between the bottom and top arms to define a bottom junction where the bottom arm meets the connector portion, said connector portion defining a second fastener receiving aperture;

said method comprising the steps of:

installing the gutter support bracket to the gutter by coupling said front coupler with said front lip and engaging the rear clip over the rear lip of the gutter;

fixing the hood support bracket to the gutter support bracket with the bottom arm adjacent the bar and the rear and bottom junctions interfitting such that said first and second fastener receiving apertures are aligned; and attaching the hood to the hood support bracket with a gap defined between the forward lip of the hood and the front lip of the support bracket.

9. The method of claim 8, wherein said step of fixing comprises mating a clip projecting from the bottom arm of the hood support bracket with a slot defined in the bar of the gutter support bracket.

10. The method of claim 8, wherein said step of attaching the hood comprises installing a fastener through the cover portion of the hood to engage the top arm of the hood support bracket.

* * * * *